US009327489B2

(12) United States Patent
Shifley et al.

(10) Patent No.: US 9,327,489 B2
(45) Date of Patent: May 3, 2016

(54) CONTROLLING LINE WIDTHS IN FLEXOGRAPHIC PRINTING

(71) Applicants: James Douglas Shifley, Spencerport, NY (US); Peter Steven Alexandrovich, Rochester, NY (US); James Albert Reczek, Rochester, NY (US)

(72) Inventors: James Douglas Shifley, Spencerport, NY (US); Peter Steven Alexandrovich, Rochester, NY (US); James Albert Reczek, Rochester, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 42 days.

(21) Appl. No.: 14/162,828

(22) Filed: Jan. 24, 2014

(65) Prior Publication Data

US 2015/0210060 A1 Jul. 30, 2015

(51) Int. Cl.

| | |
|---|---|
| ***B41F 5/24*** | (2006.01) |
| ***B41F 31/06*** | (2006.01) |
| ***B41F 31/20*** | (2006.01) |
| ***B41F 33/00*** | (2006.01) |
| ***B41F 31/00*** | (2006.01) |
| ***B41F 31/02*** | (2006.01) |

(52) U.S. Cl.

CPC ..... *B41F 5/24* (2013.01); *B41F 31/005* (2013.01); *B41F 31/022* (2013.01); *B41F 31/027* (2013.01); *B41F 31/06* (2013.01); *B41F 31/20* (2013.01); *B41F 33/0045* (2013.01); *B41P 2231/20* (2013.01); *B41P 2251/112* (2013.01); *Y10T 428/24802* (2015.01)

(58) Field of Classification Search

CPC ..... B41F 5/24; B41F 31/005; B41F 31/08; B41F 31/06; B41F 31/07; B41F 33/0045; B41F 33/0036; B41P 2231/20; B41P 2231/21

See application file for complete search history.

(56) References Cited

U.S. PATENT DOCUMENTS

| | | | | |
|---|---|---|---|---|
| 4,362,179 | A * | 12/1982 | MacPhee et al. | 137/3 |
| 4,552,165 | A | 11/1985 | Luska | |
| 5,330,576 | A | 7/1994 | Clauditz | |
| 5,967,044 | A * | 10/1999 | Marschke | 101/363 |
| 6,901,861 | B2 * | 6/2005 | Adachi et al. | 101/483 |
| 7,487,724 | B1 | 2/2009 | Evans et al. | |
| 2006/0032387 | A1 | 2/2006 | Watanabe et al. | |
| 2008/0210114 | A1 * | 9/2008 | Ning et al. | 101/484 |
| 2012/0100304 | A1 * | 4/2012 | Cruchon-Dupeyrat et al. | 427/555 |
| 2012/0186470 | A1 | 7/2012 | Marco et al. | |
| 2012/0285341 | A1 * | 11/2012 | Dedman | 101/350.1 |
| 2014/0071356 | A1 * | 3/2014 | Petcavich | G06F 3/044 349/12 |
| 2014/0158005 | A1 * | 6/2014 | Kaya et al. | 101/366 |
| 2014/0295063 | A1 * | 10/2014 | Petcavich | B41F 5/24 427/79 |

FOREIGN PATENT DOCUMENTS

| | | | |
|---|---|---|---|
| EP | 0 970 809 | 1/2000 | |
| EP | 1932669 | 11/2012 | |
| WO | 2013/063188 | 5/2013 | |
| WO | WO 2013063183 A1 * | 5/2013 | G06F 3/044 |

* cited by examiner

*Primary Examiner* — Matthew G Marini
*Assistant Examiner* — Leo T Hinze
(74) *Attorney, Agent, or Firm* — Kevin E. Spaulding

(57) ABSTRACT

A method for controlling feature characteristics in a flexographic printing system that forms a printed pattern on a substrate by applying ink from an ink reservoir using a flexographic printing plate mounted on a plate cylinder. An imaging system is used to capture an image of the pattern printed on the substrate, and the captured image is analyzed to determine a feature characteristic of one or more features of the printed pattern. A control system automatically controls an amount of solvent used to replenish the ink in the ink reservoir responsive to the determined feature characteristic.

17 Claims, 14 Drawing Sheets

CONTROLLING LINE WIDTHS IN FLEXOGRAPHIC PRINTING

CROSS REFERENCE TO RELATED APPLICATIONS

Reference is made to commonly-assigned, co-pending U.S. patent application Ser. No. 14/162,807, entitled "Flexographic printing system with solvent replenishment" by James Shifley et al.; and to commonly-assigned, co-pending U.S. patent application Ser. No. 14/162,818, entitled "Flexographic printing system providing controlled feature characteristics" by James Shifley et al., each of which is herein incorporated by reference.

FIELD OF THE INVENTION

This invention pertains to the field of flexographic printing, and more particularly to a solvent replenishment system for controlling the viscosity of ink provided to a flexographic printing plate.

BACKGROUND OF THE INVENTION

Flexography is a method of printing or pattern formation that is commonly used for high-volume printing runs. It is typically employed for printing on a variety of soft or easily deformed materials including, but not limited to, paper, paperboard stock, corrugated board, polymeric films, fabrics, metal foils, glass, glass-coated materials, flexible glass materials and laminates of multiple materials. Coarse surfaces and stretchable polymeric films are also economically printed using flexography.

Flexographic printing members are sometimes known as relief printing members, relief-containing printing plates, printing sleeves, or printing cylinders, and are provided with raised relief images onto which ink is applied for application to a printable material. While the raised relief images are inked, the recessed relief "floor" should remain free of ink.

Although flexographic printing has conventionally been used in the past for printing of images, more recent uses of flexographic printing have included functional printing of devices, such as touch screen sensor films, antennas, and other devices to be used in electronics or other industries. Such devices typically include electrically conductive patterns.

Touch screens are visual displays with areas that may be configured to detect both the presence and location of a touch by, for example, a finger, a hand or a stylus. Touch screens may be found in televisions, computers, computer peripherals, mobile computing devices, automobiles, appliances and game consoles, as well as in other industrial, commercial and household applications. A capacitive touch screen includes a substantially transparent substrate which is provided with electrically conductive patterns that do not excessively impair the transparency—either because the conductors are made of a material, such as indium tin oxide, that is substantially transparent, or because the conductors are sufficiently narrow that the transparency is provided by the comparatively large open areas not containing conductors. As the human body is also an electrical conductor, touching the surface of the screen results in a distortion of the screen's electrostatic field, measurable as a change in capacitance.

Projected capacitive touch technology is a variant of capacitive touch technology. Projected capacitive touch screens are made up of a matrix of rows and columns of conductive material that form a grid. Voltage applied to this grid creates a uniform electrostatic field, which can be measured. When a conductive object, such as a finger, comes into contact, it distorts the local electrostatic field at that point. This is measurable as a change in capacitance. The capacitance can be changed and measured at every intersection point on the grid. Therefore, this system is able to accurately track touches. Projected capacitive touch screens can use either mutual capacitive sensors or self capacitive sensors. In mutual capacitive sensors, there is a capacitor at every intersection of each row and each column. A 16×14 array, for example, would have 224 independent capacitors. A voltage is applied to the rows or columns. Bringing a finger or conductive stylus close to the surface of the sensor changes the local electrostatic field which reduces the mutual capacitance. The capacitance change at every individual point on the grid can be measured to accurately determine the touch location by measuring the voltage in the other axis. Mutual capacitance allows multi-touch operation where multiple fingers, palms or styli can be accurately tracked at the same time.

Self-capacitance sensors can use the same x-y grid as mutual capacitance sensors, but the columns and rows operate independently. With self-capacitance, the capacitive load of a finger is measured on each column or row electrode by a current meter. This method produces a stronger signal than mutual capacitance, but it is unable to resolve accurately more than one finger, which results in "ghosting", or misplaced location sensing.

WO 2013/063188 by Petcavich et. al. discloses a method of manufacturing a capacitive touch sensor using a roll-to-roll process to print a conductor pattern on a flexible transparent dielectric substrate. A first conductor pattern is printed on a first side of the dielectric substrate using a first flexographic printing plate and is then cured. A second conductor pattern is printed on a second side of the dielectric substrate using a second flexographic printing plate and is then cured. In some embodiments the ink used to print the patterns includes a catalyst that acts as seed layer during subsequent electroless plating. The electrolessly plated material (e.g., copper) provides the low resistivity in the narrow lines of the grid needed for excellent performance of the capacitive touch sensor. Petcavich et. al. indicate that the line width of the flexographically printed material can be 1 to 50 microns.

To improve the optical quality and reliability of the touch screen, it has been found to be preferable that the width of the grid lines be approximately 2 to 10 microns, and even more preferably to be 4 to 8 microns. Printing such narrow lines stretches the limits of flexographic printing technology, especially when relatively high viscosity printing inks are used. In particular, it has been found to be difficult to achieve a desired tolerance of plus or minus one micron in line width tolerance. What is needed is an inking system for a flexographic printing system that is capable of printing such narrow lines with tight control of line width.

SUMMARY OF THE INVENTION

The present invention represents a method for controlling feature characteristics in a flexographic printing system, comprising:

using the flexographic printing system to form a printed pattern on a substrate by applying ink from an ink reservoir using a flexographic printing plate mounted on a plate cylinder, wherein the flexographic printing plate has raised features corresponding to the printed pattern;

using an imaging system to capture an image of the pattern printed on the substrate;

analyzing the capture image to determine a feature characteristic of one or more features of the printed pattern; and using a control system to automatically control an amount of solvent used to replenish the ink in the ink reservoir responsive to the determined feature characteristic.

This invention has the advantage that variations in the performance of the flexographic printing system are reduced by controlling the viscosity of the ink using an ink replenishment process. In some embodiments, reduced variability of the line widths of printed linear features used in touch screen displays is achieved to increase robustness of the device fabrication process.

It has the additional advantage that feature characteristics of the printed patterns can be analyzed to control the ink replenishment process.

It has the further advantage that a distribution tube is used to supply replenished ink across a width of the ink reservoir, thereby providing a more uniform distribution of replenished ink and improving the uniformity of the ink viscosity within the ink reservoir.

Figure 1:
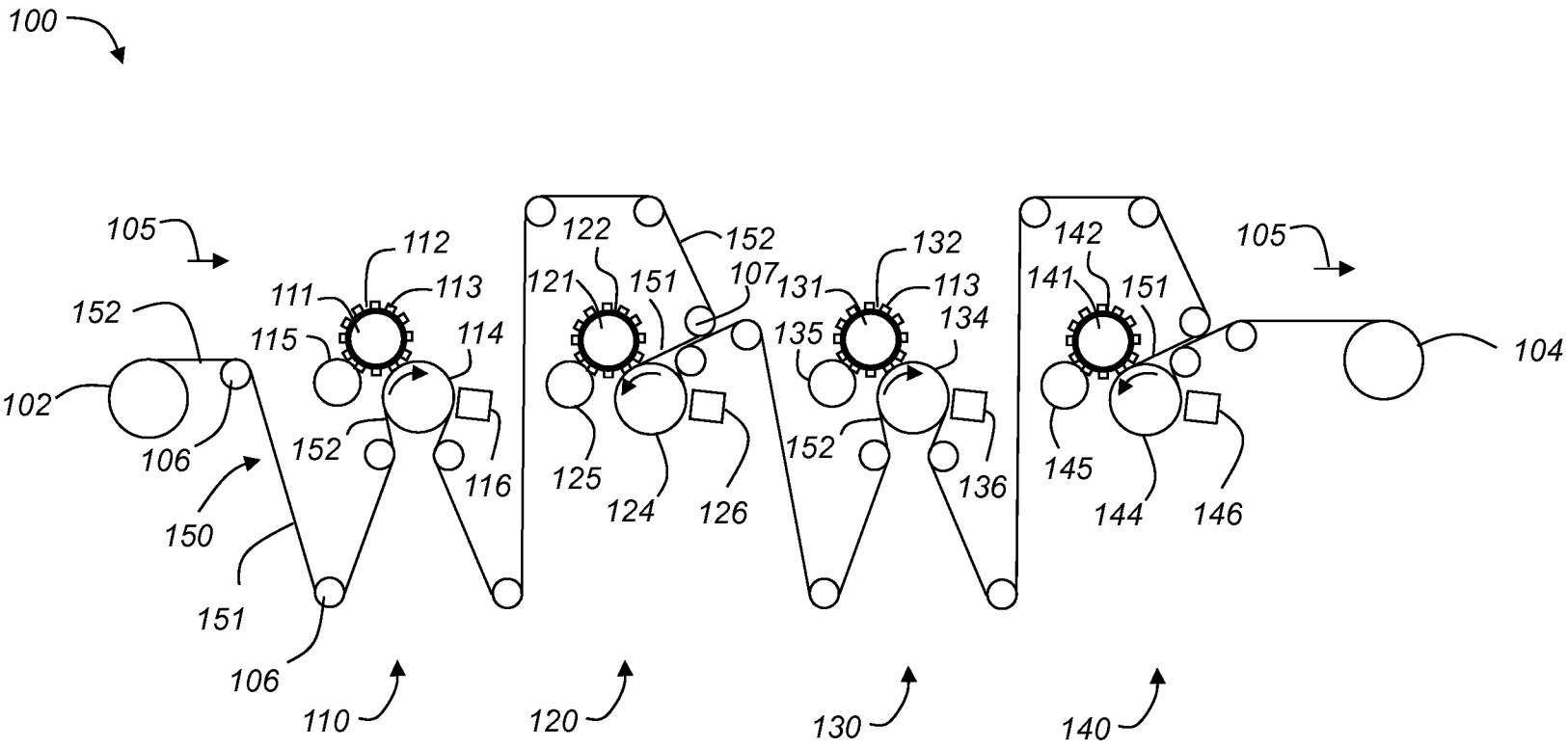
FIG. 1 is a schematic side view of a flexographic printing system for roll-to-roll printing on both sides of a substrate.

It is to be understood that the attached drawings are for purposes of illustrating the concepts of the invention and may not be to scale.

DETAILED DESCRIPTION OF THE INVENTION

The present description will be directed in particular to elements forming part of, or cooperating more directly with, an apparatus in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. It should be noted that, unless otherwise explicitly noted or required by context, the word "or" is used in this disclosure in a non-exclusive sense.

The example embodiments of the present invention are illustrated schematically and not to scale for the sake of clarity. One of ordinary skill in the art will be able to readily determine the specific size and interconnections of the elements of the example embodiments of the present invention.

As described herein, the example embodiments of the present invention provide an inking system for use in a flexographic printing system, particularly for printing functional devices incorporated into touch screens. However, many other applications are emerging for printing of functional devices that can be incorporated into other electronic, communications, industrial, household, packaging and product identification systems (such as RFID) in addition to touch screens. Furthermore, flexographic printing is conventionally used for printing of images and it is contemplated that the inking systems described herein can also be advantageous for such printing applications.

FIG. 1 is a schematic side view of a flexographic printing system 100 that can be used in embodiments of the invention for roll-to-roll printing on both sides of a substrate 150. Substrate 150 is fed as a web from supply roll 102 to take-up roll 104 through flexographic printing system 100. Substrate 150 has a first side 151 and a second side 152.

The flexographic printing system 100 includes two print modules 120 and 140 that are configured to print on the first side 151 of substrate 150, as well as two print modules 110 and 130 that are configured to print on the second side 152 of substrate 150. The web of substrate 150 travels overall in roll-to-roll direction 105 (left to right in the example of FIG. 1). However, various rollers 106 and 107 are used to locally change the direction of the web of substrate as needed for adjusting web tension, providing a buffer, and reversing a side for printing. In particular, note that in print module 120 roller 107 serves to reverse the local direction of the web of substrate 150 so that it is moving substantially in a right-to-left direction.

Each of the print modules 110, 120, 130, 140 include some similar components including a respective plate cylinder 111, 121, 131, 141, on which is mounted a respective flexographic printing plate 112, 122, 132, 142, respectively. Each flexographic printing plate 112, 122, 132, 142 has raised features 113 defining an image pattern to be printed on the substrate 150. Each print module 110, 120, 130, 140 also includes a respective impression cylinder 114, 124, 134, 144 that is configured to force a side of the substrate 150 into contact with the corresponding flexographic printing plate 112, 122, 132, 142.

More will be said below about rotation directions of the different components of the print modules 110, 120, 130, 140, but for now it is sufficient to note that the impression cylinders 124 and 144 of print modules 120 and 140 (for printing on first side 151 of substrate 150) rotate counter-clockwise in the view shown in FIG. 1, while the impression cylinders 114 and 134 of print modules 110 and 130 (for printing on second side 152 of substrate 150) rotate clockwise in this view.

Each print module 110, 120, 130, 140 also includes a respective anilox roller 115, 125, 135, 145 for providing ink to the corresponding flexographic printing plate 112, 122, 132, 142. As is well known in the printing industry, an anilox roller is a hard cylinder, usually constructed of a steel or aluminum core, having an outer surface containing millions of very fine dimples, known as cells. How the ink is controllably transferred and distributed onto the anilox roller is described below. In some embodiments, some or all of the print modules 110, 120, 130, 140 also include respective UV curing stations 116, 126, 136, 146 for curing the printed ink on substrate 150.

Figure 2:
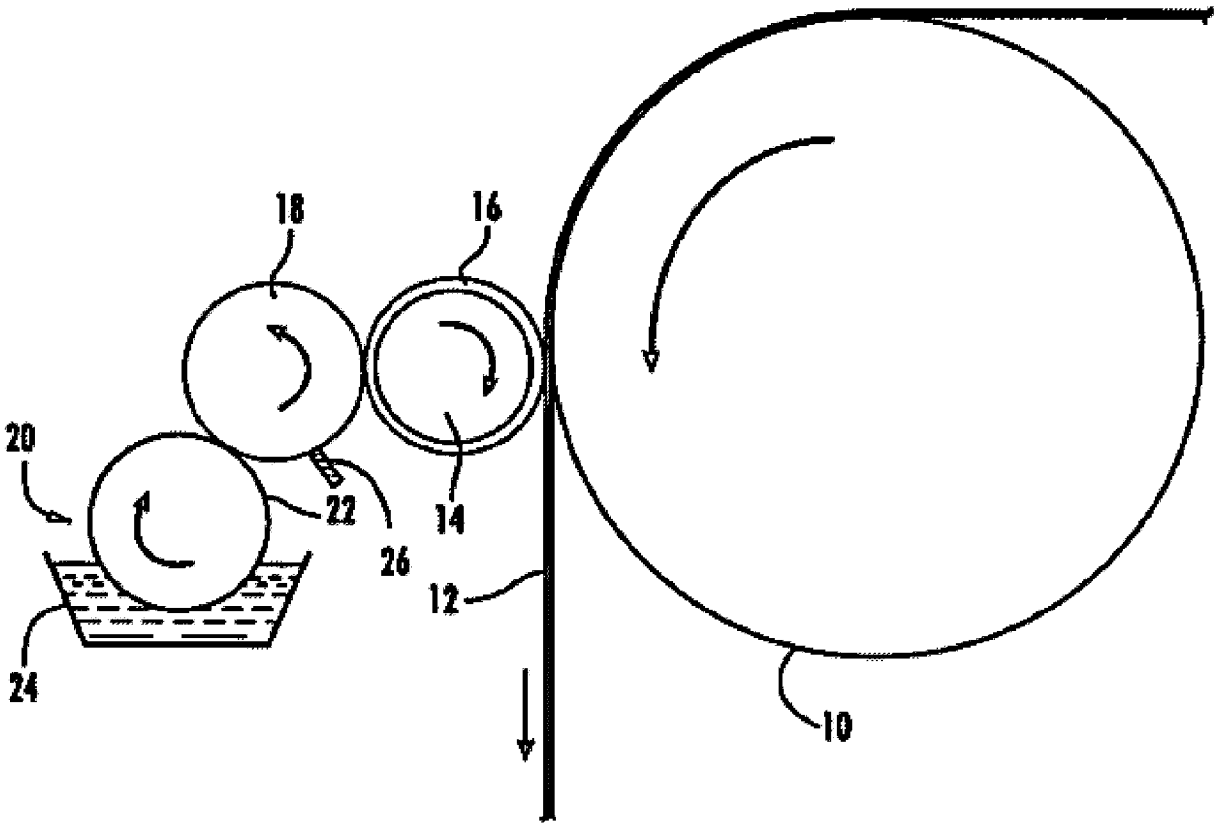
FIG. 2 (Prior Art)
FIG. 2 is a prior art flexographic printing apparatus using a fountain roller for ink delivery.
Figure 3:
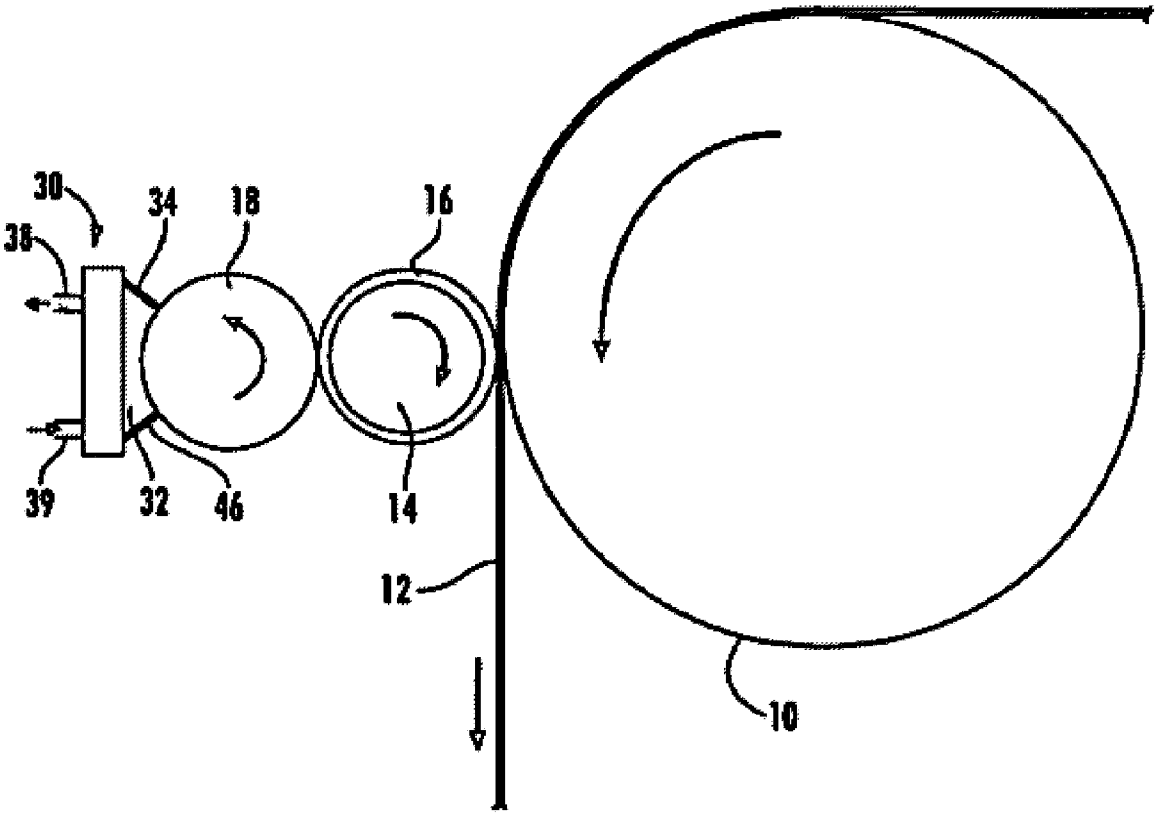
FIG. 3 (Prior Art)
FIG. 3 is a prior art flexographic printing apparatus using a reservoir chamber for ink delivery.

U.S. Pat. No. 7,487,724 to Evans et. al. discloses inking systems for an anilox roller in a flexographic printing apparatus. FIG. 2 is a copy of Evans' FIG. 1 showing a flexographic printing apparatus using a fountain roller device 20 for delivering printing liquid (also called ink herein) to an anilox roller 18. FIG. 3 is a copy of Evans' FIG. 2 showing a reservoir chamber system 30 for delivering printing liquid to the anilox roller 18. The flexographic apparatuses shown in FIGS. 2 and 3 each comprises a rotatably driven impression cylinder 10 adapted to peripherally carry and transport a printable substrate 12, such as paper or a similar web-like material. A plate cylinder 14 is rotatably disposed adjacent the impression cylinder in axially parallel coextensive relation. The circumferential periphery of the plate cylinder 14 carries one or more flexible printing plates 16 formed with an image surface (not shown), for example in a relief image form, for peripherally contacting the circumferential surface of the impression cylinder 10 and the substrate 12 thereon. The anilox roller 18 is similarly disposed adjacent the plate cylinder 14 in axially parallel coextensive relation and in peripheral surface contact therewith.

The anilox roller 18 has its circumferential surface engraved with a multitude of recessed cells, which may be of various geometric configurations, adapted collectively to retain a quantity of printing liquid in a continuous film-like form over the circumferential surface of the anilox roller 18 for metered transfer of the liquid to the image surface on the printing plate 16 of the plate cylinder 14.

The flexographic printing apparatuses of FIGS. 2 and 3 differ principally in construction and operation in the form of delivery device provided for applying printing liquid to the anilox roller 18. In the FIG. 2 apparatus, the delivery device is in the form of a so-called fountain roller device 20, wherein a cylindrical fountain roller 22 is disposed in axially parallel coextensive relation with the anilox roller 18 in peripheral surface contact therewith, with a downward facing lower portion of the fountain roller 22 being partially submerged in a pan 24 containing a quantity of printing liquid. The fountain roller 22 rotates and constantly keeps the engraved cell structure of the circumferential surface of the anilox roller 18 filled with the printing liquid, thereby forming a thin film of the liquid as determined by the size, number, volume and configuration of the cells. A doctor blade 26 is preferably positioned in angled surface contact with the anilox roller 18 downstream of the location of its contact with the fountain roller 22, as viewed in the direction of rotation of the anilox roller 18, to progressively wipe excess printing liquid from the surface of the anilox roller 18, which drains back into the pan 24.

In contrast, the flexographic printing apparatus shown in FIG. 3 does not utilize a fountain roller, but instead uses a reservoir chamber 32 positioned directly adjacent the anilox roller 18, with forwardly and rearwardly inclined blades 34, 46 disposed in axially extending wiping contact with the surface of the anilox roller 18 at a circumferential spacing from each other. Blade 34 is upstream of the contact of the printing liquid from reservoir chamber 32 with anilox roller 18, and serves as a containment blade. Blade 46 is downstream of the contact of the printing liquid from reservoir chamber 32 with anilox roller 18, and serves as a doctor blade to wipe excess printing liquid from the surface of the anilox roller 18. Printing liquid is continuously delivered into the reservoir chamber 32 at ink entry 39 and is exhausted from the reservoir chamber 32 at ink exit 38 so as to maintain a slightly positive fluid pressure within the reservoir chamber 32. In this manner, the reservoir chamber system 30 serves to constantly wet the peripheral surface of the anilox roller 18.

U.S. Patent Application Publication 2012/0186470 to Marco et al. entitled "Printing device and method using energy-curable inks for a flexographic printer," discloses a flexographic printer adapted for printing an energy-curable printing ink containing components including resin, pigment and a non-reactive evaporable component such as water or another solvent. A reservoir chamber, such as reservoir chamber 32 mentioned above with reference to FIG. 3, having an ink supply line and an ink return line is used to apply ink to the anilox roller. A reading device, such as a viscometer, is used to characterize a ratio of the non-reactive evaporable component of the printing ink in the ink supply line to the reservoir chamber 32. A suitable amount of the non-reactive evaporable component is added to the ink based on the viscometer reading.

As disclosed in commonly-assigned, co-pending U.S. patent application Ser. No. 14/146,867 to Shifley, filed Jan. 3, 2014, the disclosure of which is herein incorporated by reference, it has been found that for printing of narrow lines with somewhat viscous inks (300 centipoises to 10,000 centipoises for example), line quality is generally better when using an ink pan and a fountain roller to provide ink to the anilox roller than when using a reservoir chamber to deliver ink directly to the anilox roller. It is believed that the fountain roller is more effective in forcing viscous inks into the cells on the surface of the anilox roller than is mere contact of ink at an ink delivery portion of a reservoir chamber.

Figure 4:
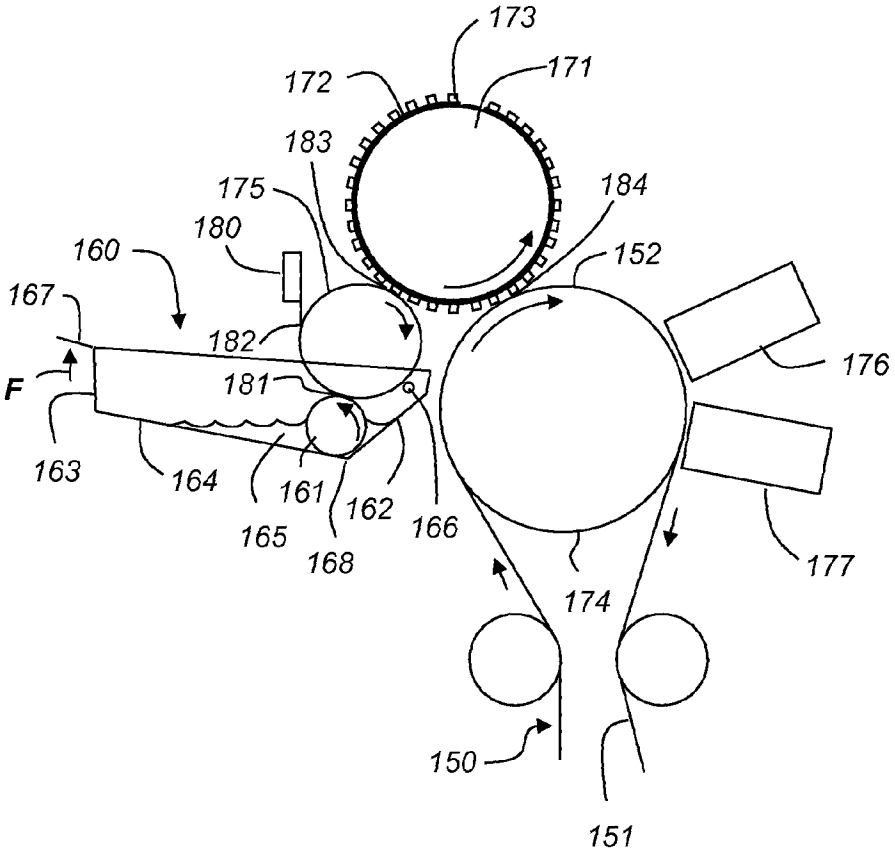
FIG. 4 is a schematic side view of an inking system using a pivotable ink pan with a fountain roller in contact with the anilox roller for a first roller rotation direction.

FIG. 4 shows a close-up side view of an ink pan 160 with a fountain roller 161 for use in flexographic printing systems for providing ink to anilox roller 175. In this embodiment, the configuration and rotation directions of impression cylinder 174, plate cylinder 171 and anilox roller 175 are similar to the corresponding impression cylinder 114, plate cylinder 111 and anilox roller 115 in print module 110 of FIG. 1.

Ink pan 160 includes a front wall 162 located nearer to impression cylinder 174, a rear wall 163 located opposite front wall 162 and further away from impression cylinder 174, and a floor 164 extending between the front wall 162 and the rear wall 163. The ink pan 160 also includes two side walls (not shown in FIG. 4) that extend between the front wall 162 and the rear wall 163 on opposite sides of the ink pan 160 and intersect the floor 164. It should be noted that there may or may not be distinct boundaries between the front wall 162, the rear wall 163, the floor 164 and the side walls. In some embodiments, some or all of the boundaries between these surfaces can be joined using rounded boundaries that smoothly transition from one surface to the adjoining surface.

Fountain roller 161 is partially immersed in an ink 165 contained in ink pan 160. Within the context of the present invention, the ink 165 can be any type of marking material, visible or invisible, to be deposited by the flexographic printing system 100 (FIG. 1) on the substrate 150. Fountain roller 161 is rotatably mounted on ink pan 160. Ink pan 160 is pivotable about pivot axis 166, preferably located near the front wall 162.

A lip 167 extends from rear wall 163. When an upward force F is applied to lip 167 as in FIG. 4, ink pan 160 pivots upward about pivot axis 166 until fountain roller 161 contacts anilox roller 175 at contact point 181. In the upwardly pivoted ink pan 160 the floor 164 tilts downward from rear wall 163 toward the front wall 162 so that fountain roller 161 is located near a lowest portion 168 of floor 164. If upward force F is removed from lip 167, ink pan 160 pivots downward under the influence of gravity so that fountain roller 161 is no longer in contact with anilox roller 175.

As described with reference to FIG. 1, a flexographic printing plate 172 (also sometimes called a flexographic master) is mounted on plate cylinder 171. In FIG. 4, flexographic printing plate 172 is a flexible plate that is wrapped almost entirely around plate cylinder 171. Anilox roller 175 contacts raised features 173 on the flexographic printing plate 172 at contact point 183. As plate cylinder 171 rotates counter-clockwise (in the view shown in FIG. 4), both the anilox roller 175 and the impression cylinder 174 rotate clockwise, while the fountain roller 161 rotates counter-clockwise Ink 165 that is transferred from the fountain roller 161 to the anilox roller 175 is transferred to the raised features 173 of the flexographic printing plate 172 and from there to second side 152 of substrate 150 that is pressed against flexographic printing plate 172 by impression cylinder 174 at contact point 184.

In order to remove excess amounts of ink 165 from the patterned surface of anilox roller 175 a doctor blade 180, which is mounted to the frame (not shown) of the printing system, contacts anilox roller 175 at contact point 182. Contact point 182 is downstream of contact point 181 and is upstream of contact point 183. For the configuration shown in FIG. 4, in order to position doctor blade 180 to contact the anilox roller 175 downstream of contact point 181 where the fountain roller 161 contacts the anilox roller 175, as well as upstream of contact point 183 where the anilox roller 175 contacts the raised features 173 on the flexographic printing plate 172, doctor blade 180 is mounted on the printer system frame on a side of the anilox roller 175 that is opposite to the impression cylinder 174.

After printing of ink on the substrate, it is cured using UV curing station 176. In some embodiments, an imaging system 177 can be used to monitor line quality of the pattern printed on the substrate as discussed in further detail below.

The configuration of the pivotable ink pan 160 with the doctor blade 180 located on the side of the anilox roller 175 that is opposite to the impression cylinder 174, as shown in FIG. 4, is compatible for the rotation directions of the rollers that are as shown in print modules 110 and 130 of FIG. 1 for printing on second side 152 of substrate 150. In such configurations (with reference to FIG. 4), the side of anilox roller 175 that moves upward toward plate cylinder 171 after receiving ink 165 from fountain roller 161 is the side that is located farther away from the front wall 162 of ink pan 160, and also farther away from impression cylinder 174. Comparing FIG. 1 with FIG. 4 it can be appreciated that for print modules 120 and 140, where the rotation directions of the impression cylinders 124 and 144 is opposite the rotation directions of the impression cylinders 114 and 134 in print modules 110 and 130, the side of the corresponding anilox rollers 125 and 145 that would move upward from the ink pans 160 (not shown in FIG. 1) toward the plate cylinders 121 and 141 would be the side that is next to the front wall 162 of ink pan 160. In some flexographic printing systems, spatial constraints due to the proximity of the impression cylinder 174 to the near side of the anilox roller 175 limit where a doctor blade could be positioned on that side of the anilox roller 175. (By contrast, the more spread-out prior art configuration shown in FIG. 2 does not have such spatial constraints, so that the doctor blade 26 can be located on that side of anilox roller 18.)

Figure 5:
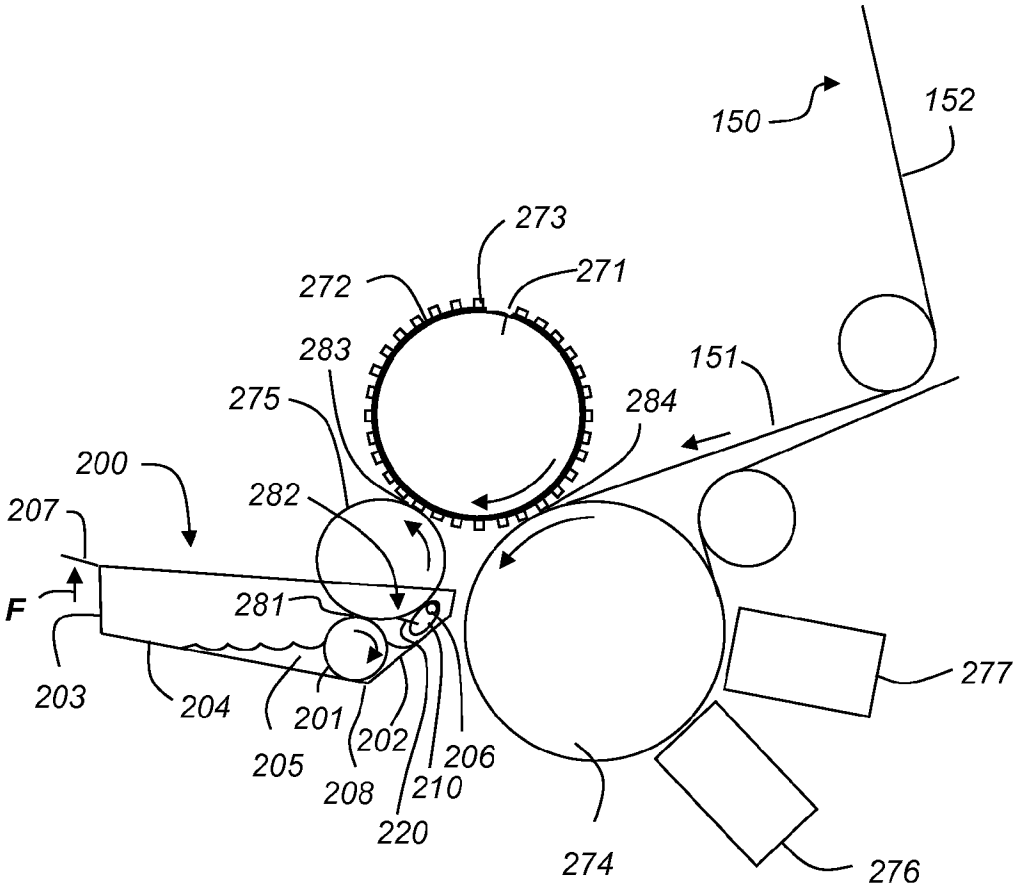
FIG. 5 is a schematic side view of an inking system using a pivotable ink pan with a fountain roller in contact with the anilox roller for a second roller rotation direction.

A close-up schematic side view of an inking system for flexographic printing using viscous inks for print modules having tight spatial constraints around the anilox roller when printing on a side of the substrate requiring that the side of the anilox roller that faces the impression cylinder moves upward is shown in FIG. 5. The configuration shown in FIG. 5 can be used, for example, for print modules 120 and 140 in FIG. 1 where the web of substrate 150 reverses direction for printing on first side 151, such that a direction of rotation of impression cylinder 274 causes a surface of the impression cylinder 274 to move in a downward direction on a side of the impression cylinder 274 facing front wall 202 of ink pan 200. In the configuration of FIG. 5, pivotable ink pan 200 with fountain roller 201 positioned in proximity to lowest portion 208 of floor 204 of ink pan 200 is used to transfer ink 205 to anilox roller 275 at contact point 281. Ink 205 is transferred to raised features 273 of flexographic printing plate 272 on plate cylinder 271 at contact point 283 and is subsequently printed onto first side 151 of substrate 150, being pressed into contact by impression cylinder 274 at contact point 284. As in FIG. 4, a force F can be applied to lip 207 on rear wall 203 of the ink pan 200 to pivot the ink pan 200 around the pivot axis 206, bringing the fountain roller 201 into contact with the anilox roller 275. UV curing station 276 is optionally provided for curing the printed ink on first side 151 of substrate 150. Imaging system 277 is provided for monitoring the line quality of the lines printed on the substrate 150.

As disclosed in commonly-assigned, co-pending U.S. patent application Ser. No. 14/146,867, fitting doctor blade 220 within the tight spatial constraints downstream of contact point 281 and upstream of contact point 283 (where anilox roller 275 transfers ink 205 to raised features 273 of flexographic printing plate 272) can be addressed by mounting the doctor blade 220 to the ink pan 200 on the side of the anilox roller 275 that is nearest to the impression cylinder 274. In particular, doctor blade 220 can be mounted within ink pan 200 using a blade holder 210 positioned near the front wall 202 of the ink pan 200 such that the doctor blade 220 contacts the anilox roller 275 at contact point 282.

It has recently been found that it is difficult to maintain tight tolerances (plus or minus one micron for example) on line width of narrow lines as the ink increases in viscosity due to evaporation of solvent in the ink. Although ink recirculation and solvent replenishment for a reservoir chamber have previously been disclosed in U.S. Patent Application Publication No. 2012/0186470 as described above, ink replenishment in an ink pan for a flexographic printing system is typically done by pouring additional ink into the ink tank. The newly added ink does not always mix well with the residual ink that is still in the ink pan. Such incomplete mixing can result in ink viscosity variation within the ink pan, giving rise to excessive variation in line width and quality of the printed narrow lines.

Figure 6:
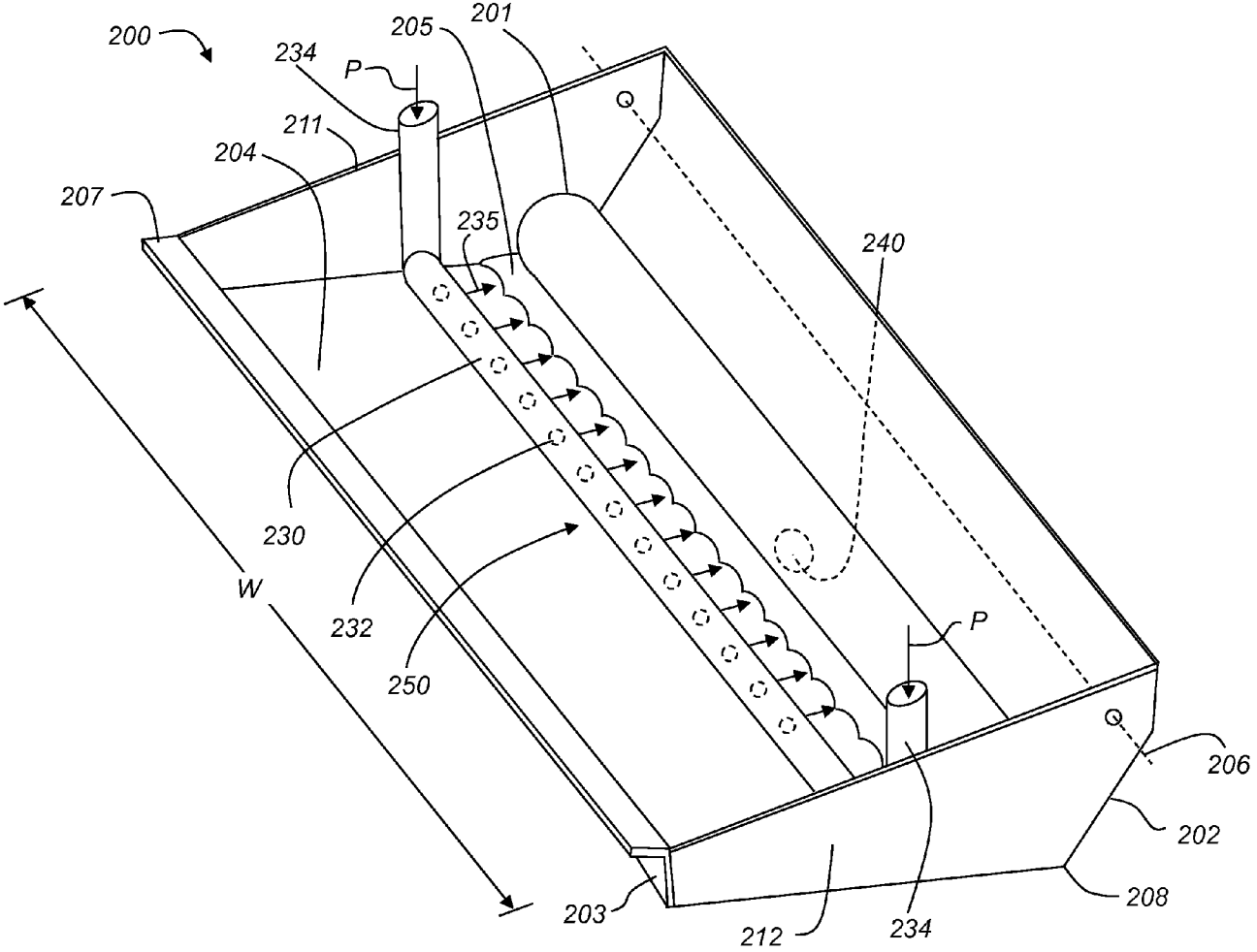
FIG. 6 is a top perspective of an ink pan for ink recirculation according to an embodiment of the invention.

FIG. 6 shows a top perspective of an ink pan 200 for use with an ink recirculation system 250 (see FIG. 8) according to an embodiment of the invention. FIG. 6 does not show the configuration of the doctor blade as the ink recirculation system 250 of the invention is applicable to both the ink pan 160 of FIG. 4 and the ink pan 200 of FIG. 5. (In other words, the numbering of ink pan 200 in FIG. 6 is meant to be exemplary rather than exclusively referring to the inking system of FIG. 5.) First side wall 211 and its opposing second side wall 212 are shown in this perspective as extending between the front wall 202 and the rear wall 203 and intersecting the floor 204. A width W of ink pan 200 is defined by first and second side walls 211 and 212.

Some components of ink recirculation system 250 are shown in FIG. 6. In particular, an ink recirculation port 240 is disposed near the center of the width W of ink pan 200 near front wall 202 and near a lowest portion 208 of the floor 204 of the ink pan 200. Ink recirculation port 240 is hidden behind fountain roller 201 in FIG. 6, but it is more clearly shown in the perspective of FIG. 7, where the fountain roller 201 has been removed for clarity. In some embodiments (not shown) there is a plurality of ink recirculation ports in proximity to the lowest portion 208 of the floor of the ink pan 200.

Figure 7:
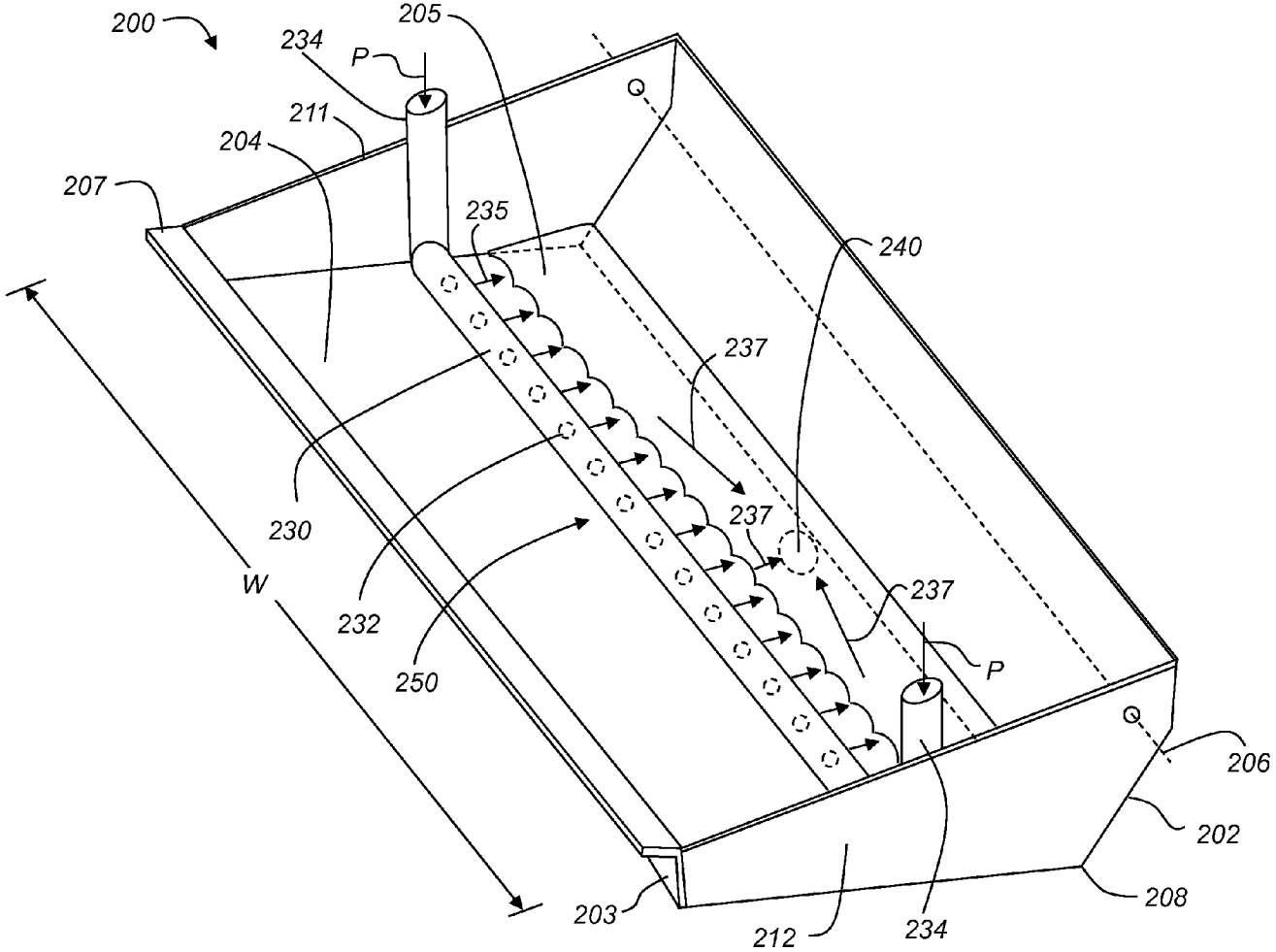
FIG. 7 is similar to FIG. 6, but with the fountain roller hidden.

Ink 205 is drawn out of the ink pan 200 through the ink recirculation port 240 as described in further detail below. Solvent replenished ink is returned to the ink pan 200 via ink distribution tube 230. Ink distribution tube 230 can have a cylindrical geometry as shown in FIGS. 6 and 7, or alternatively can have other configurations. Ink distribution tube 230 includes a plurality of ink supply ports 232 at a plurality of spaced apart locations across the width W of the ink pan 200. Ink distribution tube 230 is preferably substantially parallel (i.e., within about 20 degrees of parallel) to a rotation axis of fountain roller 201. In a preferred embodiment, pressure P is applied to both ends of ink distribution tube 230 using pressurized lines 234. In the example shown in FIGS. 6 and 7, ink supply ports 232 are disposed along a bottom of ink distribution tube 230 aimed toward floor 204, although this is not a requirement. In some embodiments, ink supply ports 232 can be equally spaced and have equal cross-sectional areas as shown. In such a configuration, more ink tends to flow out of the ink supply ports 232 that are located nearest to pressurized lines 234. In other embodiments, the cross-sectional area or the spacing of ink supply ports 232 along the ink distribution tube 230 can be unequal in order to compensate for pressure drops along the ink distribution tube 230 and provide a more uniform distribution of replenished ink across width W of ink pan 200.

The replenished ink flows downward toward ink 205 along replenished ink entry paths 235. As indicated in FIG. 7, if a single (or dominant) ink recirculation port 240 is substantially centrally located along the width W, a cross flow of the replenished ink can be established as indicated by ink flow 237 toward ink recirculation port 240. Such a cross flow can also help the mixing of the replenished ink with the ink 205 in ink pan 200 so that viscosity of ink 205 within the ink pan 200 is substantially uniform.

Figure 8:
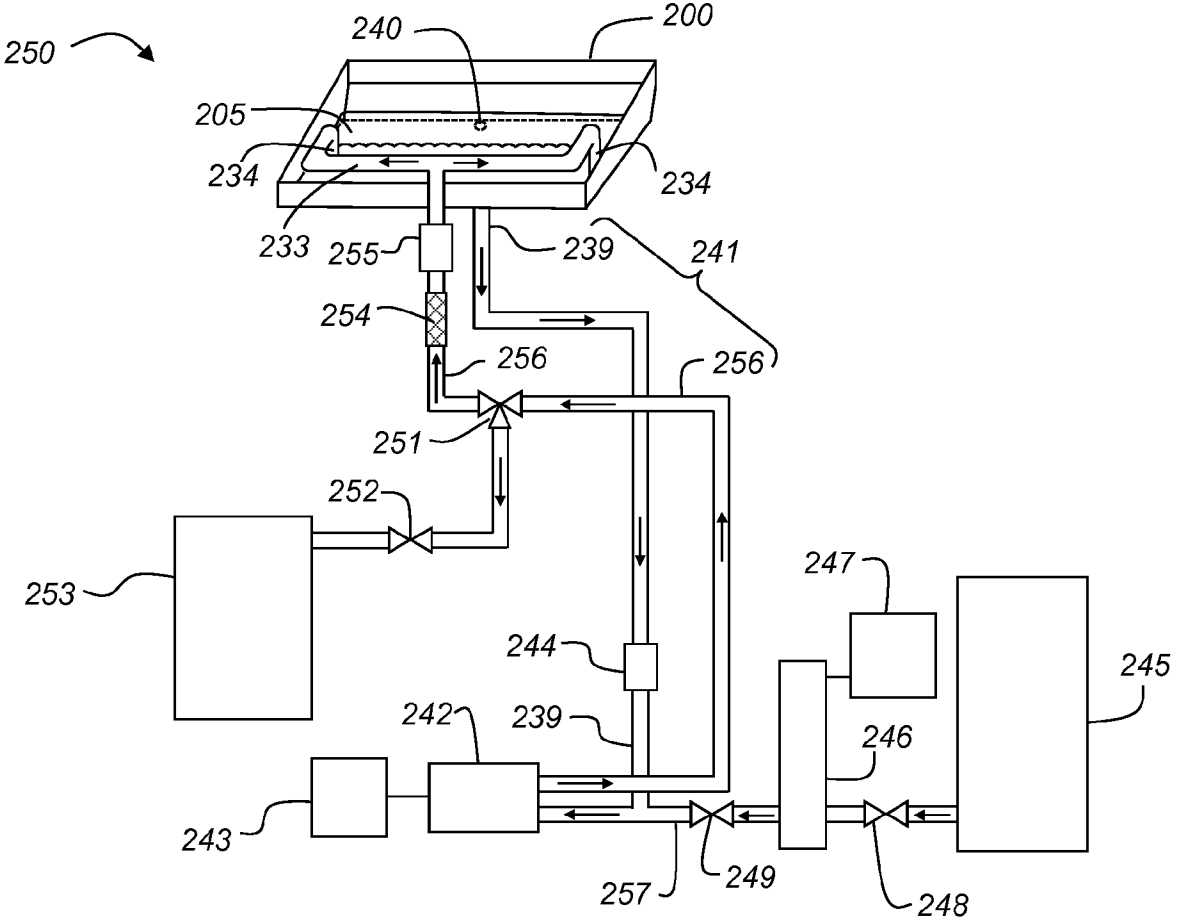
FIG. 8 is a schematic of an ink recirculation and solvent replenishment system according to an embodiment of the invention.

FIG. 8 shows a schematic of the ink recirculation system 250 according to an embodiment of the invention. Direction of ink flow is indicated by the straight arrows. The fountain roller 201 (FIG. 6) is hidden in this figure in order to show ink recirculation port 240 more clearly. Furthermore, the ink distribution tube 230 (FIG. 6) is not visible in the perspective of FIG. 8.

Ink 205 exits ink pan 200 via ink drain line 239 due to the pumping action of ink recirculation pump 242, and optionally assisted by gravity. In some embodiments ink recirculation pump 242 is a peristaltic pump. Action of ink recirculation pump 242 is controlled by control system 243. Ink is then moved back toward ink pan 200 via ink return line 256. Collectively, the ink drain line 239 and the ink return line 256 are referred to as ink recirculation line 241. The ink drain line 239 is on the low pressure side of ink recirculation pump 242, while ink return line 256 is on the high pressure side.

In accordance with the present invention, the ink recirculation system 250 is used to maintain the viscosity of ink 205 at or near a target viscosity level in order to reduce variability in the performance of the flexographic printing system 100 (FIG. 1). The target viscosity level will typically fall between 10 centipoises and 20,000 centipoises, and in a preferred embodiment will be between 200 centipoises and 2,000 centipoises. In order to maintain the viscosity of the ink 205 at the target level, it is necessary to maintain the solvent in the ink at an appropriate concentration. It is therefore necessary to replenish the solvent in the ink 205 as it evaporates during operation of the flexographic printing system 100. To replenish the solvent, solvent from a solvent replenishment chamber 245 is pumped by metering pump 246 into solvent replenishment line 257 and enters ink recirculation pump 242 together with ink 205 from ink drain line 239. Valve 249 can be used to isolate metering pump 246 from the solvent replenishment line 257.

Particularly for embodiments where the viscosity of the ink 205 is much higher than the viscosity of the solvent, it is found that simply pumping solvent into the ink 205 does not mix them to a sufficiently uniform extent. It is therefore advantageous to incorporate a mixing device 254 in the ink recirculation system 250 to provide sufficiently uniform solvent-replenished ink. In the example shown in FIG. 8, mixing device 254 is provided inline with ink return line 256. Mixing device 254 can be a dynamic mixing device or a static inline mixing device. In some embodiments, a dynamic mixing device includes moving parts such as blades to stir the ink 205 and solvent together. In some embodiments, a static inline mixing device includes a series of non-moving baffles that cause the ink and solvent to blend into each other as they flow through the torturous path of the static mixing device.

A rate of flow of solvent into solvent replenishment line 257 is controlled by control system 247 for metering pump 246. In some embodiments metering pump 246 is a piston pump or a syringe pump. The rate of flow can be controlled by an amount of solvent delivered per stroke, as well as the frequency of strokes of the metering pump 246. The preferred rate of flow is dependent on the evaporation rate of the solvent, which can depend on factors such as the volatility of the solvent, the temperature, and the surface area of exposed ink. In some exemplary embodiments the solvent flow rate is controlled to between 0.1 and 1 gram per minute.

In some embodiments the rate of evaporation in a print module of flexographic printing system 100 (FIG. 1) can be accurately characterized using a configuration process and control of solvent replenishment by control system 247 can be simply time-based without referring to real-time measured characteristics.

In other embodiments, the viscosity of the ink 205 in ink recirculation line 241 can be measured by a viscometer 244 positioned upstream of solvent replenishment line 257. (The words upstream and downstream are used herein in their conventional sense. Flow of a material proceeds from upstream to downstream.) Alternatively, a viscometer 255 can be provided in the ink return line 256 downstream of the mixing device 254. In such embodiments employing a viscometer 244, 255, the control system 247 controls the flow rate of solvent provided by the metering pump 246 responsive to the measured viscosity of the ink 205. When the viscosity of the ink 205 gets larger than a target viscosity, the flow rate of solvent can be increased accordingly. Similarly, when the viscosity of the ink 205 falls below the target viscosity, the flow rate of solvent can be decreased. In this way, variations of the viscosity of the ink 205 in the ink pan 200 as a function of time are reduced relative to the target viscosity.

In still other embodiments, imaging system 177 (FIG. 4) or imaging system 277 (FIG. 5) can be used to capture an image of the pattern printed on substrate 150. The captured image is analyzed to determine a feature characteristic of one or more features of the printed pattern, and control system 247 controls the flow rate of solvent provided by metering pump 246 responsive to the determined feature characteristic. For example, the feature characteristic can be the width of a printed line. It has been found that the printed line width typically varies as a function of ink viscosity, and therefore as a function of solvent concentration. Therefore, the control system 247 can use a measured line width from an image captured by the imaging system 177, 277 as an indication of the ink viscosity, and can adjust the flow rate of solvent such that variations of the measured line width are reduced relative to a target line width. In one exemplary embodiment, it was found the printed line width changed by about 0.2 micron per each 1% change in solvent concentration. For line width printing tolerances of plus or minus one micron in narrow lines that are between 2 microns and 10 microns wide, it is evident that the viscosity in such an example would need to be controlled within a few percent.

In alternate embodiments, rather than basing the flow rate of solvent on a measured line width, other feature characteristics of the printed pattern can be used to characterize the printer response. Those skilled in the art will recognize that any aspect of the printed pattern that is found to vary as a function of the ink viscosity can be used as appropriate feature characteristics for controlling the flow rate of solvent. Examples of such feature characteristics would include an optical density of a printed feature (e.g., the optical density of a line), an integrated (i.e., average) density or transmittance of the printed pattern, or an optical scattering characteristic of the printed pattern.

Also shown the in ink recirculation system 250 of FIG. 8 is an ink recovery tank 253. In some applications, the ink 205 can be very expensive. When it is desired to purge the ink 205 from the printing system, the ink 205 in ink pan 200, as well as in ink recirculation line 241, can be pumped into the ink recovery tank 253. In an exemplary embodiment, a multi-position ink recovery valve 251 is provided downstream of the ink recirculation pump 242. When the ink recovery valve 251 is in a first position the ink is directed to pressure manifold 233, which allows ink to flow through the pressurized lines 234 at the ends of the ink distribution tube 230 (FIG. 6). The ink is then directed from both ends through the ink distribution tube 230 and out of the ink supply ports 232 (FIG. 6) into the ink pan 200. When the ink recovery valve 251 is in a second position, the ink is diverted into the ink recovery tank 253. Optionally, after the ink has been moved to the ink recovery tank 253, the ink recirculation system 250 can be solvent flushed for maintaining good flow through the various lines and orifices.

In some embodiments, it can be advantageous to provide independent control of flow rate of solvent for some or all of the various print modules 110, 120, 130, 140 of the flexographic printing system 100 (FIG. 1). In some instances this can be due to different types of ink and different volatility of solvent used for different print modules. In other instances the environmental conditions, such as temperature, can be different for different print modules. In still other instances, the dwell time of the ink on the flexographic printing plate can be different among different print modules, which leads to different amounts of evaporation of solvent prior to printing on substrate 150. In particular, consider the inking system shown in FIG. 4 that can be employed for print modules 110 and 130 (FIG. 1) for printing on second side 152 of substrate 150 as discussed above. After ink is transferred from anilox roller 175 to flexographic printing plate 172 at contact point 183, plate cylinder 171 only needs to rotate counterclockwise by about 60 degrees before the ink is printed on second side 152 of substrate 150 at contact point 184. In contrast, for the inking system shown in FIG. 5 that can be employed for print modules 120 and 140 (FIG. 1) for printing on first side 151 of substrate 150, after ink is transferred from anilox roller 275 to flexographic printing plate 272 at contact point 283, plate cylinder 271 needs to rotate clockwise by about 300 degrees before the ink is printed on first side 151 of substrate 150 at contact point 284. Thus the dwell time of the ink in a very thin layer on flexographic printing plate 272 (FIG. 5) is about 5 times as long as it is on flexographic printing plate 172 (FIG. 4). This can lead to a higher rate of solvent evaporation in print modules 120 and 140 than in print modules 110 and 130 (FIG. 1). As a result, the control systems 247 for the metering pumps 246 in print modules 120 and 140 may need to provide a higher flow rate than the control systems 247 for the metering pumps 246 in print modules 110 and 130.

To save on space and cost in the flexographic printing system 100 (FIG. 1) it can also be advantageous in some cases to share portions of ink recirculation system 250 among the different print modules 110, 120, 130 and 140 rather than duplicating all components in each print module. With reference also to FIG. 8, two components that can be particularly useful to share among a plurality of print modules are the solvent replenishment chamber 245 and the ink recovery tank 253. In some embodiments, a valve 248 can be associated with the solvent replenishment chamber 245. In some configurations, the valve 248 can be a shut-off valve isolating solvent replenishment chamber 245. In other configurations, the valve 248 can be a multi-position valve allowing connection of the solvent replenishment chamber 245 to ink recirculation systems 250 for a plurality of print modules 110, 120, 130 and 140. Similarly, a valve 252 can be associated with the ink recovery tank 253. In some configurations, the valve 252 can be a multi-position valve allowing connection of ink recovery tank 253 to ink recirculation systems 250 for a plurality of print modules 110, 120, 130 and 140.

Figure 9:
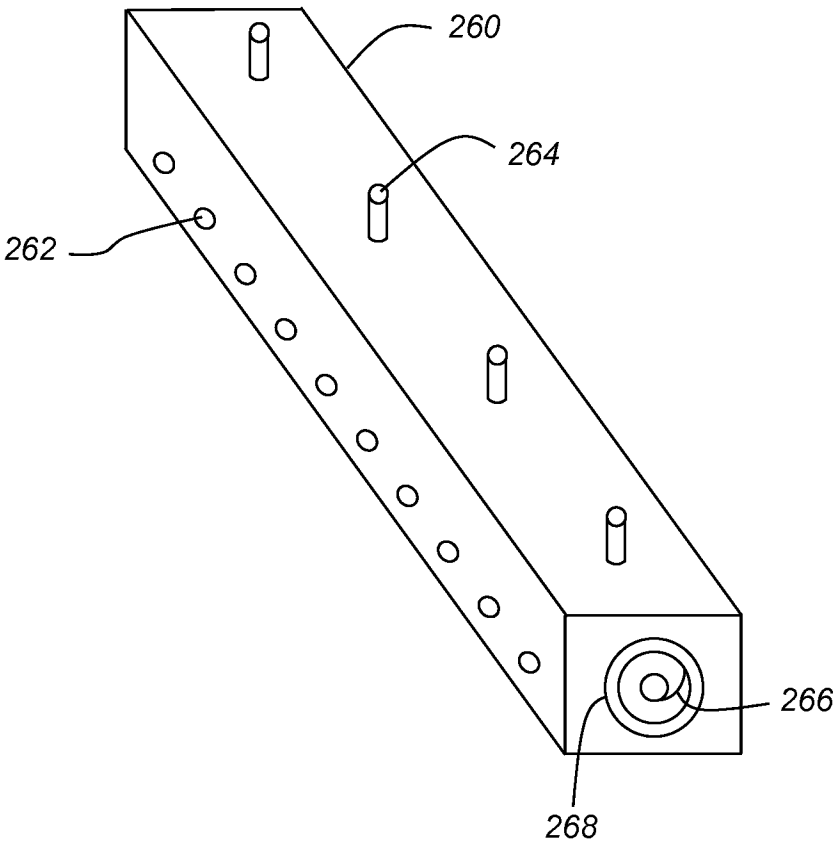
FIG. 9 is a dynamic mixing device that can be provided in the ink pan in an embodiment of the invention.

In some embodiments it can be advantageous to provide a dynamic mixing device 260, as shown in the perspective in FIG. 9, which is positioned within ink pan 200 (FIG. 6) in order to provide more complete mixing of the replenished ink 205 (FIG. 6) along the width of the ink pan 200. In the example shown in FIG. 9, the dynamic mixing device 260 can be incorporated into the ink distribution tube 230 of FIG. 6. Replenished ink 205 enters the dynamic mixing device 260 via one or more pressurized lines 264 and passes into a mixing chamber 268. One or more rotating blades 266 are arrayed along the mixing chamber 268 and mix the ink 205 throughout the mixing chamber 268. The mixed ink 205 exits supply ports 262 into ink pan 200. In typical operation an end cap (not shown in FIG. 9 in order to view the rotating blade 266) would cover the mixing chamber 268 at the end of the dynamic mixing device 260. The rotating blades can be provided in a variety of forms such as an auger, or two side-by-side augers for example, depending upon the level of mixing required. In other embodiments (not shown) a dynamic mixing device 260 can have blades or other stirring mechanisms that move within the ink 205 on the floor 204 of ink pan 200 (FIG. 6) in order to provide more complete mixing of the residual ink 205 in the ink pan 200 and the replenished ink 205 supplied by the ink recirculation system 250 (FIG. 8).

Figure 10:
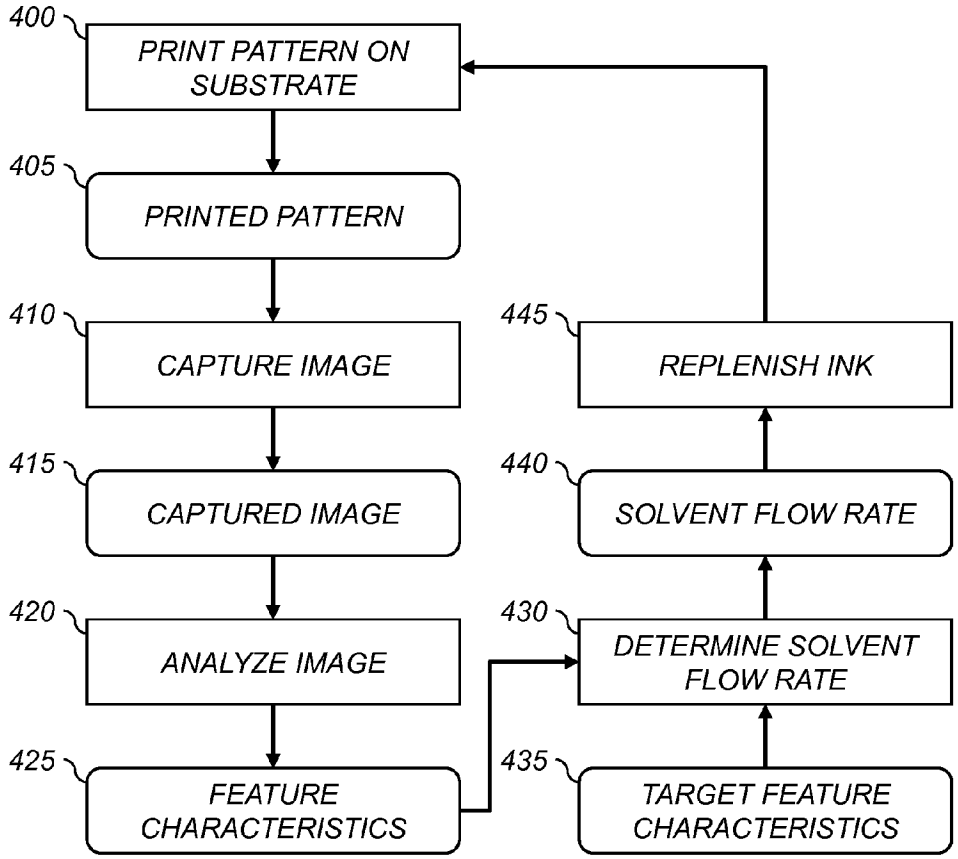
FIG. 10 is a flow chart of a method for controlling feature characteristics in accordance with a preferred embodiment of the invention.

FIG. 10 shows a flow chart for an exemplary method for controlling feature characteristics in accordance with a preferred embodiment of the invention. A print pattern on substrate step 400 is used to form a printed pattern 405 on a substrate 150 using a print module 110, 120, 130, 140 flexographic printing system 100 (see FIG. 1). As discussed earlier, this typically involves using an anilox roller 275 to transfer ink 205 to raised features 273 on a flexographic printing plate 272 (see FIG. 5). The ink 205 is transferred from the flexographic printing plate 272 to the substrate 150 as it passes between plate cylinder 271 and impression cylinder 274. The printed pattern 405 contains a pattern of printed features having associated feature characteristics. In some embodiments, the printed pattern includes a plurality of printed lines having associated line widths. In this case, the line width of a printed line is an example of a feature characteristic.

A capture image step 410 is used to capture an image of the printed pattern 405 thereby providing a captured image 415. In an exemplary embodiment, the captured image 415 is captured using the imaging system 277 (FIG. 5). The captured image 415 will typically include a two-dimensional (2D) array of image pixels, each image pixel having an associated pixel value. In some embodiments the imaging system 277 can be a digital camera system that includes a 2D image sensor which captures the captured image 415 all at once. In other embodiments, the imaging system 277 can include a one-dimensional (1D) linear image sensor that captures one line of the captured image 415 at a time as the substrate moves past the imaging system 277.

An analyze image step 420 automatically analyzes the captured image 415 to determine one or more feature characteristics 425 of the features in the printed pattern 405. The analyze image step 420 is generally performed using a data processor which performs appropriate image processing and analysis algorithms which will be well-known to one skilled in the art. The phrases "data processor" is intended to include any data processing device, such as a central processing unit (CPU), a desktop computer, a laptop computer, a mainframe computer or any other device for processing data, managing data, or handling data, whether implemented with electrical, magnetic, optical, biological components, or otherwise. In an exemplary embodiment where the printed pattern 405 includes a series of printed lines, the analyze image step 420 analyzes the captured image 415 to determine feature characteristics 425 corresponding to the line widths of the printed lines. In some embodiments, line widths are determined for a plurality of lines and are combined to provide one or more summary statistics characterizing the distribution of line widths within the captured image 415 (e.g., the mean line width, the maximum and minimum line widths, and the standard deviation of the line widths). Other examples of feature characteristics that can be determined would include an optical density of a feature (e.g., the optical density of a printed line), an integrated density or transmittance of the printed pattern, or an optical scattering characteristic of the printed pattern.

A determine solvent flow rate step 430 determines an amount of solvent to be added to the ink 205 (FIG. 5) responsive to the determined feature characteristics 425. In a preferred embodiment, the determine solvent flow rate step 430 compares the determined feature characteristics 425 to predefined target feature characteristics 435 and adjusts a solvent flow rate 440 for solvent added to the ink 205 in the ink recirculation system 250 (FIG. 8). In an exemplary embodiment, if a difference between a determined line width and a target line width is less than a predefined threshold, the solvent flow rate 440 is not changed, but if the difference between determined line width and the target line width is more than the predefined threshold, the solvent flow rate 440 is adjusted accordingly. For example, if the determined line width is found to be larger than the target line width, it can be concluded that the viscosity of the ink 205 is too large and the solvent flow rate 440 can be increased accordingly to reduce the viscosity of the ink 205 back to an appropriate level. Similarly, if the determined line width is found to be smaller than the target line width, it can be concluded that the viscosity of the ink 205 is too small and the solvent flow rate 440 can be decreased accordingly to increase the viscosity of the ink 205 back to an appropriate level. It will be appreciated by one skilled in the art that the determine solvent flow rate step 430 can use any appropriate method known in the process control art to control the solvent flow rate 440. For example, it may be desirable to compute moving averages of the feature characteristics to reduce measurement error effects, and to limit the rate at which the solvent flow rate changes to provide a damping effect.

In some embodiments, a plurality of different feature characteristics 425 are determined for the printed pattern 405. For example, the analyze image step 420 can determine both the optical densities and line widths of a set of printed lines. In this case, target feature characteristics 435 can be determined for each of the different feature characteristics 425. The determine solvent flow rate step 430 can then compare each feature characteristics 425 to the corresponding target feature characteristic 435 during the process of determining the solvent flow rate 440. In some cases, estimated flow rates can be determined as a function of the feature characteristic differences for each of the different feature characteristics. The solvent flow rate 440 can then be determined by performing a weighted average of the estimated flow rates. Alternately, a multi-dimensional function can be determined with determines the solvent flow rate 440 as a function of the plurality of feature characteristic differences.

A replenish ink step 445 is then used to replenish the ink 205 (FIG. 5) according to the determined solvent flow rate 440. In a preferred embodiment, the replenish ink step 445 adds the solvent to the ink using the ink recirculation system described with reference to FIG. 8. In this case, the control system 247 controls the metering pump 246 according to the determined solvent flow rate 440.

The steps shown in FIG. 10 are repeated iteratively during the operation of the flexographic printing system 100 (FIG. 1) to provide real-time control of the feature characteristics 425 of the printed pattern 405. In this way, variations of the feature characteristics 425 as a function of time are reduced relative to the target feature characteristics 435.

The exemplary methods for controlling the feature characteristics produced by a flexographic printing system 100 (FIG. 1) have been described with reference to print modules 110, 120, 130, 140 (FIG. 1) where the ink reservoir containing the ink 205 is an ink pan 200 (e.g., see FIG. 5). It will be recognized by one skilled in the art that the same method can be used to control print modules that use other types of ink reservoirs. For example, the method can be used to replenish the ink in the print module of FIG. 3 where the ink reservoir is a reservoir chamber system 30. In this case, the ink recirculation system 250 (FIG. 8) would draw the ink out of the reservoir chamber 32 through the ink exit 38 and return the replenished ink back into the reservoir chamber 32 through the ink entry 39.

Figure 11:
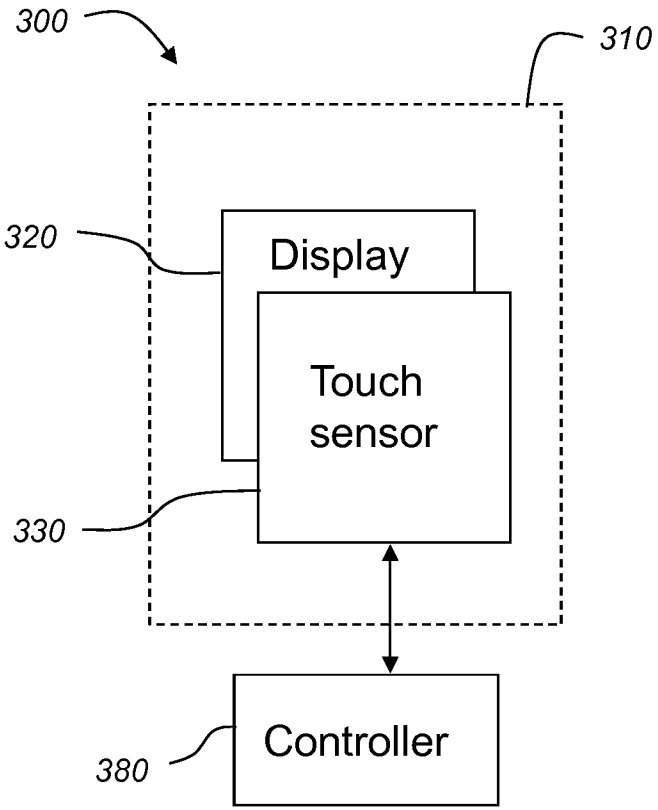
FIG. 11 is a high-level system diagram for an apparatus having a touch screen with a touch sensor that can be printed using embodiments of the invention.

FIG. 11 shows a high-level system diagram for an apparatus 300 having a touch screen 310 including a display device 320 and a touch sensor 330 that overlays at least a portion of a viewable area of display device 320. Touch sensor 330 senses touch and conveys electrical signals (related to capacitance values for example) corresponding to the sensed touch to a controller 380. Touch sensor 330 is an example of an article that can be printed on one or both sides by the flexographic printing system 100 including print modules that incorporate embodiments of ink recirculation systems 250 described above.

Figure 12:
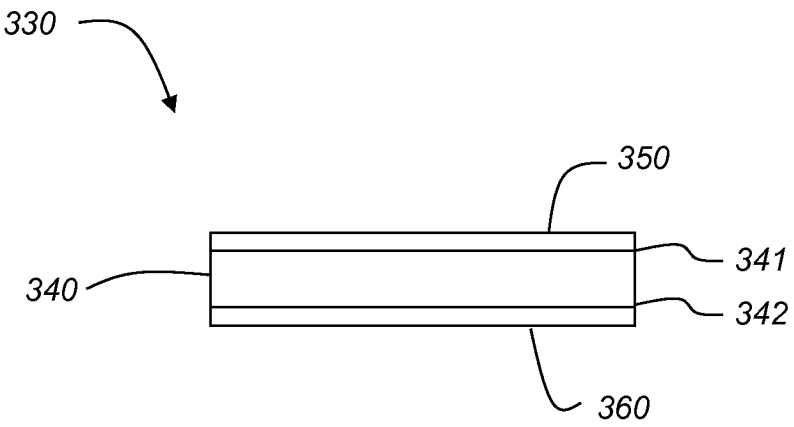
FIG. 12 is a side view of the touch sensor of FIG. 11.

FIG. 12 shows a schematic side view of a touch sensor 330. Transparent substrate 340, for example polyethylene terephthalate, has a first conductive pattern 350 printed on a first side 341, and a second conductive pattern 360 printed on a second side 342. The length and width of the transparent substrate 340, which is cut from the take-up roll 104 (FIG. 1), is not larger than the flexographic printing plates 112, 122, 132, 142 of flexographic printing system 100 (FIG. 1), but it could be smaller than the flexographic printing plates 112, 122, 132, 142. Optionally, the first conductive pattern 350 and the second conductive pattern 360 can be plated using a plating process for improved electrical conductivity after flexographic printing and curing of the patterns. In such cases it is understood that the printed pattern itself may not be conductive, but the printed pattern after plating is electrically conductive.

Figure 13:
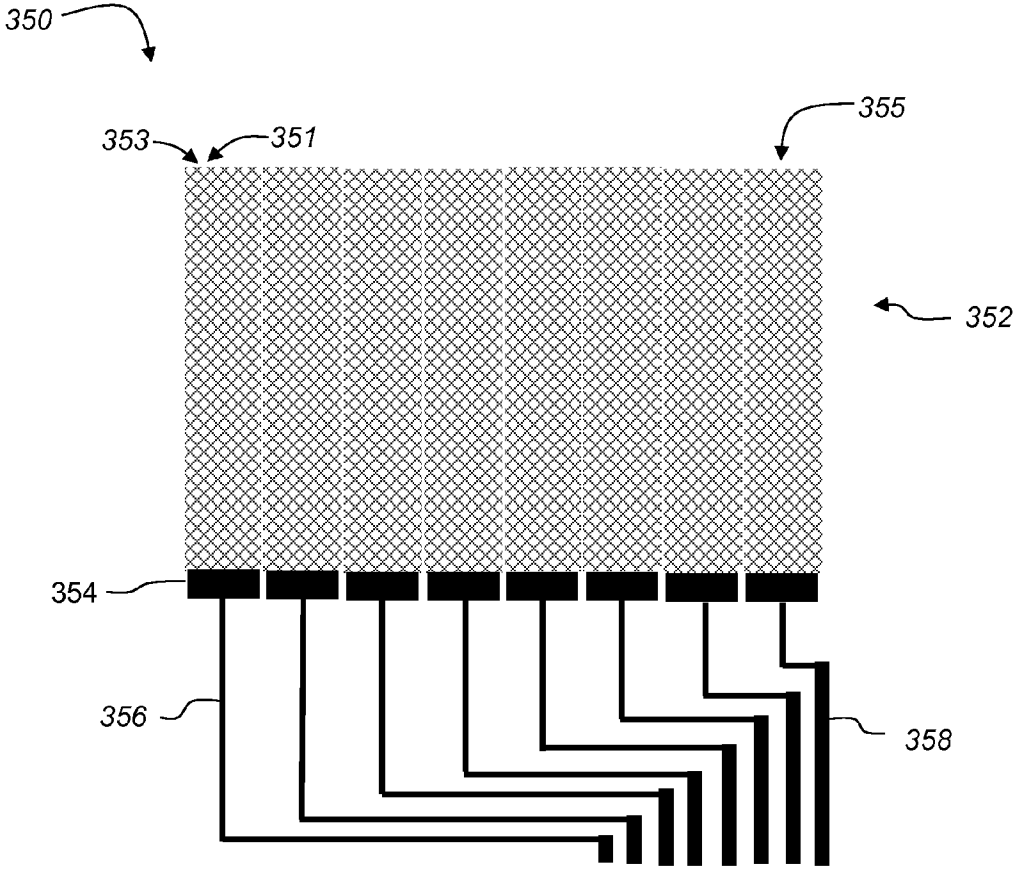
FIG. 13 is a top view of a conductive pattern printed on a first side of the touch sensor of FIG. 12.

FIG. 13 shows an example of a conductive pattern 350 that can be printed on first side 341 (FIG. 12) of substrate 340 (FIG. 12) using one or more print modules such as print modules 120 and 140 of flexographic printing system (FIG. 1). Conductive pattern 350 includes a grid 352 including grid columns 355 of intersecting fine lines 351 and 353 that are connected to an array of channel pads 354. Interconnect lines 356 connect the channel pads 354 to the connector pads 358 that are connected to controller 380 (FIG. 11). Conductive pattern 350 can be printed by a single print module 120 in some embodiments. However, because the optimal print conditions for fine lines 351 and 353 (e.g., having line widths on the order of 4 to 8 microns) are typically different than for printing the wider channel pads 354, connector pads 358 and interconnect lines 356, it can be advantageous to use one print module 120 for printing the fine lines 351 and 353 and a second print module 140 for printing the wider features. Furthermore, for clean intersections of fine lines 351 and 353 it can be further advantageous to print and cure one set of fine lines 351 using one print module 120, and to print and cure the second set of fine lines 353 using a second print module 140, and to print the wider features using a third print module (not shown in FIG. 1) configured similarly to print modules 120 and 140.

Figure 14:
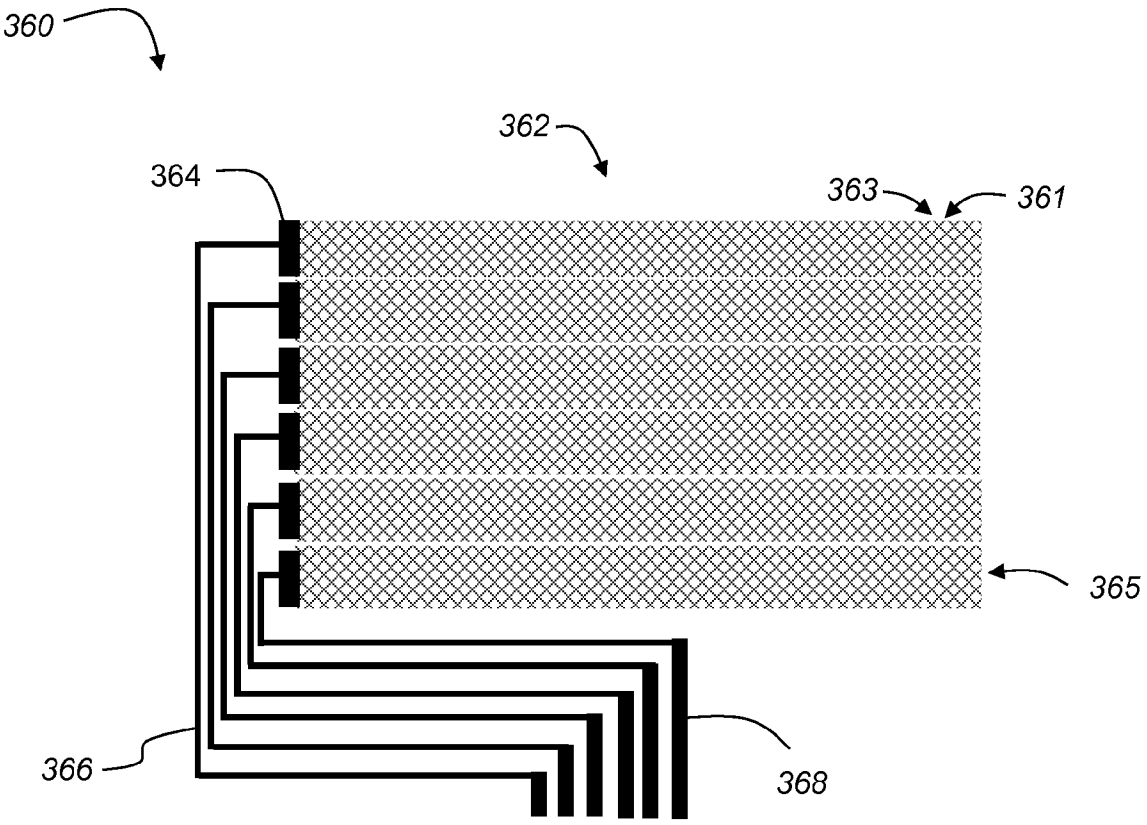
FIG. 14 is a top view of a conductive pattern printed on a second side of the touch sensor of FIG. 12.

FIG. 14 shows an example of a conductive pattern 360 that can be printed on second side 342 (FIG. 12) of substrate 340 (FIG. 12) using one or more print modules such as print modules 110 and 130 of flexographic printing system (FIG. 1). Conductive pattern 360 includes a grid 362 including grid rows 365 of intersecting fine lines 361 and 363 that are connected to an array of channel pads 364. Interconnect lines 366 connect the channel pads 364 to the connector pads 368 that are connected to controller 380 (FIG. 11). In some embodiments, conductive pattern 360 can be printed by a single print module 110. However, because the optimal print conditions for fine lines 361 and 363 (e.g., having line widths on the order of 4 to 8 microns) are typically different than for the wider channel pads 364, connector pads 368 and interconnect lines 366, it can be advantageous to use one print module 110 for printing the fine lines 361 and 363 and a second print module 130 for printing the wider features. Furthermore, for clean intersections of fine lines 361 and 363 it can be further advantageous to print and cure one set of fine lines 361 using one print module 110, and to print and cure the second set of fine lines 363 using a second print module 130, and to print the wider features using a third print module (not shown in FIG. 1) configured similarly to print modules 110 and 130.

Alternatively in some embodiments conductive pattern 350 can be printed using one or more print modules configured like print modules 110 and 130, and conductive pattern 360 can be printed using one or more print modules configured like print modules 120 and 140 of FIG. 1.

With reference to FIGS. 11-14, in operation of touch screen 310, controller 380 can sequentially electrically drive grid columns 355 via connector pads 358 and can sequentially sense electrical signals on grid rows 365 via connector pads 368. In other embodiments, the driving and sensing roles of the grid columns 355 and the grid rows 365 can be reversed.

The invention has been described in detail with particular reference to certain preferred embodiments thereof, but it will be understood that variations and modifications can be effected within the spirit and scope of the invention.

PARTS LIST

10 impression cylinder
12 substrate
14 plate cylinder
16 printing plate
18 anilox roller
20 fountain roller device
22 fountain roller
24 pan
26 doctor blade
30 reservoir chamber system
32 reservoir chamber
34 blade
38 ink exit
39 ink entry
46 blade
100 flexographic printing system
102 supply roll
104 take-up roll
105 roll-to-roll direction
106 roller
107 roller
110 print module
111 plate cylinder
112 flexographic printing plate
113 raised features
114 impression cylinder
115 anilox roller
116 UV curing station
120 print module
121 plate cylinder
122 flexographic printing plate
124 impression cylinder
125 anilox roller
126 UV curing station
130 print module
131 plate cylinder
132 flexographic printing plate
134 impression cylinder
135 anilox roller
136 UV curing station
140 print module
141 plate cylinder
142 flexographic printing plate
144 impression cylinder
145 anilox roller
146 UV curing station
150 substrate
151 first side
152 second side

160 ink pan
161 fountain roller
162 front wall
163 rear wall
164 floor
165 ink
166 pivot axis
167 lip
168 lowest portion
171 plate cylinder
172 flexographic printing plate
173 raised features
174 impression cylinder
175 anilox roller
176 UV curing station
177 imaging system
180 doctor blade
181 contact point
182 contact point
183 contact point
184 contact point
200 ink pan
201 fountain roller
202 front wall
203 rear wall
204 floor
205 ink
206 pivot axis
207 lip
208 lowest portion
210 blade holder
211 first side wall
212 second side wall
220 doctor blade
230 ink distribution tube
232 ink supply port
233 pressure manifold
234 pressurized line
235 replenished ink entry path
237 ink flow
239 ink drain line
240 ink recirculation port
241 ink recirculation line
242 ink recirculation pump
243 control system
244 viscometer
245 solvent replenishment chamber
246 metering pump
247 control system
248 valve
249 valve
250 ink recirculation system
251 ink recovery valve
252 valve
253 ink recovery tank
254 mixing device
255 viscometer
256 ink return line
257 solvent replenishment line
260 dynamic mixing device
262 supply port
264 pressurized line
266 rotating blade
268 mixing chamber
271 plate cylinder
272 flexographic printing plate
273 raised features
274 impression cylinder
275 anilox roller
276 UV curing station
277 imaging system
281 contact point
282 contact point
283 contact point
284 contact point
300 apparatus
310 touch screen
320 display device
330 touch sensor
340 transparent substrate
341 first side
342 second side
350 conductive pattern
351 fine lines
352 grid
353 fine lines
354 channel pads
355 grid column
356 interconnect lines
358 connector pads
360 conductive pattern
361 fine lines
362 grid
363 fine lines
364 channel pads
365 grid row
366 interconnect lines
368 connector pads
380 controller
400 print pattern on substrate step
405 printed pattern
410 capture image step
415 captured image
420 analyze image step
425 feature characteristics
430 determine solvent flow rate step
435 target feature characteristics
440 solvent flow rate
445 replenish ink step
F force
P pressure
W width

The invention claimed is:

1. A method for controlling feature characteristics in a flexographic printing system, comprising:

using the flexographic printing system to form a printed pattern on a substrate by applying ink from an ink reservoir using a flexographic printing plate mounted on a plate cylinder, wherein the flexographic printing plate has raised features corresponding to the printed pattern;

using an imaging system to capture an image of the pattern printed on the substrate;

analyzing the capture image to determine a feature characteristic of one or more features of the printed pattern; and using a control system to automatically control an amount of solvent used to replenish the ink in the ink reservoir responsive to the determined feature characteristic, wherein the feature characteristic is a line width.

2. The method of claim 1, wherein the amount of solvent used to replenish the ink is controlled by adjusting a flow rate at which the solvent is added to the ink.

3. The method of claim 2, wherein the flow rate of the solvent is controlled such that variations of the feature characteristic as a function of time are reduced relative to a target feature characteristic.

4. The method of claim 1, wherein the line width is between 2 microns and 10 microns.

5. The method of claim 1, wherein an ink recirculation system is used to replenish the ink in the ink reservoir, the ink recirculation system including:

an ink recirculation line that is connected to the ink recirculation ports of the ink reservoir;

a solvent replenishment chamber containing solvent;

a metering pump for pumping a controlled flow rate of solvent from the solvent replenishment chamber into the ink recirculation line thereby providing replenished ink;

a control system for controlling the flow rate of solvent provided by metering pump; and a recirculation pump for moving ink through the ink recirculation line and returning the replenished ink to the ink reservoir.

6. The method of claim 5, wherein the ink recirculation system further includes a distribution tube that receives the replenished ink from the ink recirculation line and supplies the replenished ink to the ink reservoir, wherein the distribution tube includes a plurality of supply ports for supplying the replenished ink to the ink reservoir at a plurality of spaced apart locations across a width of the ink reservoir.

7. The method of claim 5, wherein the ink recirculation system further includes a mixing device for mixing the solvent and the ink to provide the replenished ink.

8. The method of claim 7, wherein the mixing device includes a static inline mixer.

9. The method of claim 7, wherein the mixing device includes a dynamic mixing device.

10. The method of claim 5, wherein the recirculation pump is a peristaltic pump.

11. The method of claim 5, wherein the flexographic printing system includes a plurality of print modules each including a corresponding ink reservoir and a corresponding flexographic printing plate, and wherein at least a portion of the ink recirculation system is shared among the plurality of print modules.

12. The method of claim 1, wherein the flexographic printing system includes a plurality of print modules each including a corresponding ink reservoir and a corresponding flexographic printing plate, and wherein a flow rate of the solvent is independently controlled for at least two of the print modules.

13. The method of claim 1, wherein the flexographic printing system includes a dynamic ink reservoir mixing device disposed within the ink reservoir.

14. The method of claim 1, wherein a viscosity of the ink is between 10 centipoises and 20,000 centipoises.

15. The method of claim 1, wherein the ink reservoir is an ink pan.

16. The method of claim 15, wherein an anilox roller is used to transfer ink from the ink reservoir to the flexographic printing plate, and wherein a fountain roller that is at least partially immersed in the ink in the ink pan is used to transfer ink to the anilox roller.

17. The method of claim 1, wherein the ink reservoir is an ink reservoir chamber.

* * * * *